US006269229B1

(12) United States Patent
Yamamoto

(10) Patent No.: US 6,269,229 B1
(45) Date of Patent: Jul. 31, 2001

(54) IMAGE FORMING APPARATUS

(75) Inventor: Masanori Yamamoto, Toyokawa (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/531,526

(22) Filed: Mar. 21, 2000

(30) Foreign Application Priority Data

Mar. 30, 1999 (JP) ..... 11-088237

(51) Int. Cl.[7] ..... G03G 15/01
(52) U.S. Cl. ..... 399/75; 399/167; 399/299
(58) Field of Search ..... 399/167, 75, 299, 399/36

(56) References Cited

U.S. PATENT DOCUMENTS 5,016,062 * 5/1991 Rapkin ..... 399/300
5,216,475 * 6/1993 Ohno ..... 399/75
6,142,690 * 11/2000 Yoshimura et al. ..... 399/299 X

FOREIGN PATENT DOCUMENTS 9-114171 5/1997 (JP) .

* cited by examiner

*Primary Examiner*—Sophia S. Chen
(74) *Attorney, Agent, or Firm*—McDermott, Will & Emery

(57) ABSTRACT

An image forming apparatus has first to fourth photoconductor drums, a driving source (i.e, motor), a transmitting member for transmitting power of the driving source to the photoconductor drums to rotate the photoconductor drums (i.e, gears and belts), a first restricting member being rotatably held and being coupled to the first and second photoconductor drums to restrict rotations of the first and second photoconductor drums (i.e, gear), the first restricting member being a member different from the transmitting member and a second restricting member being rotatably held and being coupled to the third and fourth photoconductor drums to restrict rotations of the third and fourth photoconductor drums (i.e, gear), and the second restricting member being a member different from the transmitting member.

16 Claims, 4 Drawing Sheets

IMAGE FORMING APPARATUS

RELATED APPLICATION

This application is based on application Ser. No. 11-088237 filed in Japan, the entire content of which is hereby incorporated by reference.

BACKGROUND OF THE INVENTION

1. Field of the Invention

The present invention relates to an image forming apparatus applying color electrophotographic technology such as a color copier and a color printer.

2. Description of the Related Art

An electrophotographic process is used for image forming apparatuses such as digital copiers and laser printers. The electrophotographic process is to form an electrostatic latent image on the surface of a photoconductor drum by use of a photoconduction phenomenon and cause particles (toner) charged to the opposite polarity to adhere to the electrostatic latent image by electrostatic force to thereby form a visible image (development). Conventionally, dominating image forming apparatuses have been ones using only black toner and forming images (monochrome images) with the toner and the color of the paper. In recent years, however, image forming apparatuses forming color images with four colors, i.e. the three primary colors (yellow, magenta and cyan) and black have been becoming dominant.

Normally, in a tandem image forming apparatus, to form a color image, four photoconductor drums corresponding to the four colors are used and the four colors are superimposed one on another on the sheet of paper. Since colors are formed by superimposing the four colors, a color shift results in a color different from the intended one. Moreover, human eyes are sensitive even to a slight color shift. For this reason, in order that no color shift occurs, it is necessary to precisely convey paper and rotate the four photoconductor drums so as to be in synchronism with one another with high precision. Moreover, inconstant rotation speeds of the photoconductor drums significantly affect the color development.

Conventional image forming apparatuses include a type using one motor for one photoconductor drum, that is, using four drive motors for driving the four photoconductor drums, and a type in which the power of one drive motor is transmitted to the four photoconductor drums by a transmitting mechanism. The former type is inevitably high in cost because as many motors as the photoconductor drums are necessary and it is difficult to drive the photoconductor drums so as to be in synchronism with one another. In the latter type, the rotation speeds of the photoconductor drums tend to be inconstant because of vibrations generated by the gears and timing belts of the power transmitting system. FIG. 6 shows an outline of an image forming apparatus of the latter type and photoconductor drum driving systems.

A charging unit 50, an exposure unit 51, a developer unit 52 and a transfer unit 53 are disposed around each of the photoconductor drums 1K, 1Y, 1M, 1C corresponding to the colors. One transfer belt 14 is disposed along all the photoconductor drums 1K, 1Y, 1M, 1C. Toner images developed on the photoconductor drums are transferred to the transfer belt 14. The power of a drive motor 52 is transmitted to each pulley 55 by timing belts and gears. The power is further transmitted from the pulleys 55 to the photoconductor drums 1K, 1Y, 1M, 1C by gears and timing belts 56. Further descriptions of the operations, functions and more detailed structures of these elements are omitted because they are similar to those of a conventional tandem color image forming apparatus.

In such conventional driving of the photoconductor drums 1K, 1Y, 1M, 1C, vibrations are generated due to the mesh between gears and between the timing belts 56 and pulleys 55. Moreover, resonance occurs when the frequency of the vibrations coincides with the characteristic frequency of the power transmitting systems. The vibrations lead to inconstant rotation speeds of the photoconductor drums. This results in slight disaccord in rotation timings of the four rotary drums. Such inconstant rotation speeds of the photoconductor drums and disaccord in rotation timings of the photoconductor drums adversely affect images.

SUMMARY OF THE INVENTION

An object of the present invention is to solve the above-mentioned problems.

Another object of the present invention is to provide an image forming apparatus preventing the rotation timings of photoconductor drums from disaccording with one another.

Yet another object of the present invention is to provide an image forming apparatus forming images without any color shifts or color nonuniformness.

Still another object of the present invention is to provide an image forming apparatus preventing the rotation timings of photoconductor drums from disaccording from one another, and forming images without any color shifts or color nonuniformness.

These and other objects are attained by an image forming apparatus having first and second photoconductor drums, a driving member for rotating the first and second photoconductor drums, and a restricting member coupled to the first and second photoconductor drums to restrict rotations of the first and second photoconductor drums by associating the rotations apart from the driving member.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawing.

DESCRIPTION OF THE PREFERRED EMBODIMENT

First Embodiment

Figure 7:
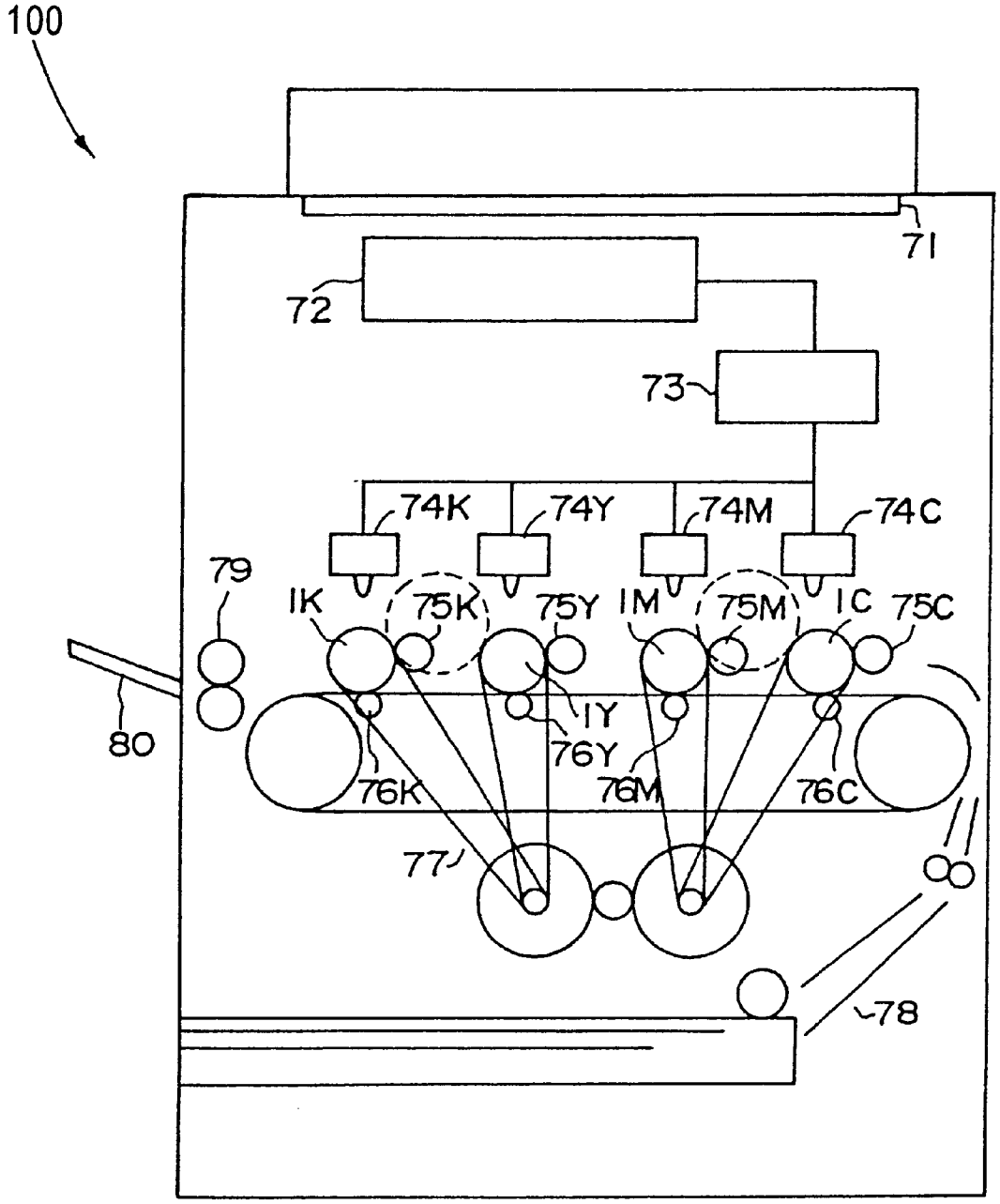
FIG. 7 is a schematic view of a color digital copier of the first embodiment.

FIG. 7 is a schematic view of a color digital copier 100. An original stand glass 71 is disposed on the top surface of the body of the color digital copier 100, and a reading optical system 72 is disposed immediately therebelow. The reading optical system 72 comprises a scanner for irradiating an original and outputting reflected light, a mirror for directing the reflected light to a condenser lens, a slider for holding and operating the mirror, and the condenser lens for condensing the reflected light.

An image reading unit 73 for reading the condensed light is disposed below the reading optical system 72. The image reading unit 73 comprises a CCD for converting the light condensed by the reading optical system 72 into electric signals for each of the red (R), green (G) and blue (B) components, and a controller for converting the electric signals converted by the CCD into image data of cyan (C), magenta (M), yellow (Y) and black (K) and driving subsequently-described exposure scanning units 74C to 74K. The exposure scanning units 74C to 74K are disposed below the image reading unit 73. Photoconductor drums 1C to 1K are disposed immediately below the exposure scanning units 74C to 74K, respectively. Developer units 75C to 75K are disposed on the right of the photoconductor drums 1C to 1K, respectively. A transfer belt 14 is disposed below the photoconductor drums 1C to 1K. Inside the transfer belt 14, transfer rollers 76C to 76K are disposed in positions opposed to the photoconductor drums 1C to 1K, respectively. A photoconductor driver 77 for driving the photoconductor drums 1C to 1K is disposed in the vicinity of the transfer belt 14. A paper feeding unit 78 is disposed below the transfer belt 14. Recording paper is conveyed into the gaps between the photoconductor drums 1C to 1K and the transfer belt 14. Fixing rollers 79 are disposed on the left of the transfer belt 14, and a paper ejecting unit 80 is disposed on the left of the fixing rollers 79.

In the color digital copier 100 having the above-described structure, first, the reading optical system 72 irradiates the original placed on the original stand glass 71 with light, and condenses the reflected light. The reflected light is output to the image reading unit 73. The image reading unit 73 converts the image into image data and transmits it to the exposure scanning units 74C to 74K. Based on the image data, the exposure scanning units 74C to 74K perform exposure on the photoconductor drums 1C to 1K with laser beams to form electrostatic latent images on the surfaces of the photoconductor drums 1C to 1K. The electrostatic latent images are developed into toner images by the developer units 75C to 75K causing toner to adhere to the electrostatic latent images. When the recording paper fed from the paper feeding unit 78 is conveyed to the gaps between the photoconductor drums 1C to 1K and the transfer belt 14, a voltage is applied to the transfer rollers 76C to 76K so that the toner images are transferred onto the recording paper. As mentioned later, the photoconductor drums 1C to 1K are rotated in synchronism with one another by the photoconductor driver 77, and the toner images on the photoconductor drums 1C to 1K are superimposed without any shifts to form an image. Then, the image is fixed onto the recording paper by the fixing rollers 79, and the recording paper is conveyed to the paper ejecting unit 80.

Next, the photoconductor driver 77 will be detailed.

Figure 1:
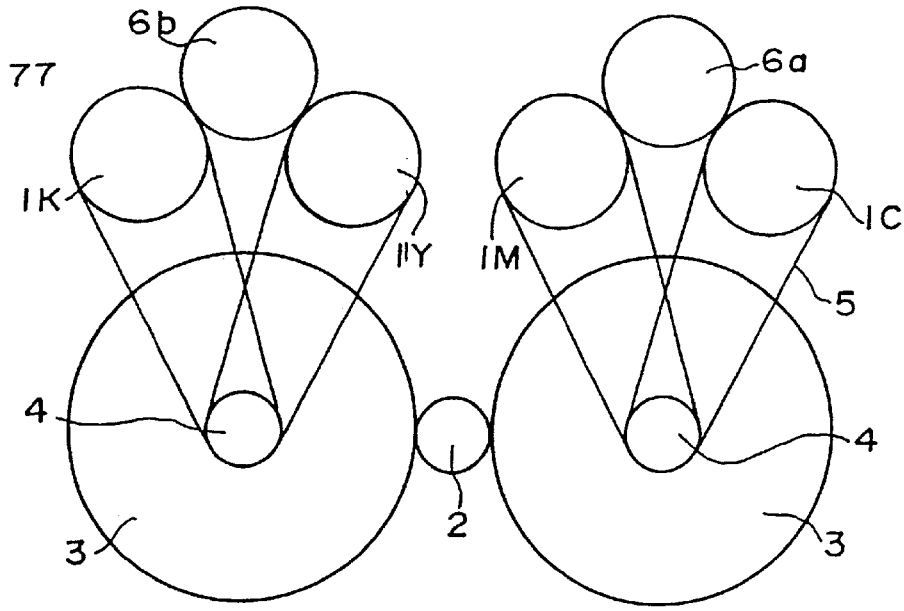
FIG. 1 is a schematic view of a photoconductor driver for explaining the first embodiment.

FIG. 1 is a schematic view of the photoconductor driver 77 for explaining the first embodiment.

One drive motor (not shown) has a gear 2 on the output shaft thereof. The gear 2 meshes with two reduction gears 3. Each reduction gear 3 has a coaxial pulley 4 meshing with timing belts 5.

The timing belts 5 mesh with coaxial photoconductor pulleys of the photoconductor drums 1C to 1K. Since the rotation of the drive motor is transmitted to the gear 2, the reduction gears 3, the pulleys 4, the timing belts 5 and the photoconductor drums 1C to 1K, when the gear ratio is the same on the path leading to the photoconductor drums 1C to 1K, the photoconductor drums 1C to 1K rotate basically at the same speed. As described above, these members constitute a power transmitter for transmitting the power by the mesh of the gears.

In this power transmitter, however, unavoidable vibrations are generated when the gears and the teeth of the timing belts mesh with the corresponding gears. Since the vibrations are transmitted to the photoconductor drums 1C to 1K, part of the vibrations, as well as the intended rotation, are superimposed on the photoconductor drums 1C to 1K.

Moreover, in the power transmitter, since a moment of inertia, torsion and stretch of the belts are present, a vibrating system is naturally formed. For this reason, even slight vibrations added from the outside produce resonance when the frequency (the number of vibrations) of the vibrating system and the frequency of the added vibrations coincide with each other. This results in vibrations larger than the added vibrations.

Since the power transmitting paths from the drive motor to the photoconductor drums 1C to 1K differ among the positions of the photoconductor drums 1C to 1K, the vibration characteristics are different.

For these reasons, the photoconductor drums 1C to 1K do not always rotate at the same speed and it is therefore inevitable that the rotation timings thereof slightly disaccord with one another. This causes color shifts and nonuniformness in formed images.

In this embodiment, a photoconductor coupling gear 6*a* meshes with the gears provided on the photoconductor drums 1C and 1M and a photoconductor coupling gear 6*b* meshes with the gears provided on the photoconductor drums 1Y and 1K, thereby forming a power transmitting system different from the power transmitter. Since the photoconductor coupling gear 6*a* forcibly couples the photoconductor drums 1C and 1M and the photoconductor coupling gear 6*b* forcibly couples the photoconductor drums 1Y and 1K, the photoconductor drums are restrained from making vibrational rotation differently from one another due to the vibrational components transmitted from the power transmitter. This prevents the rotation timings of the photoconductor drums from disaccording with one another.

Second Embodiment

Figure 2:
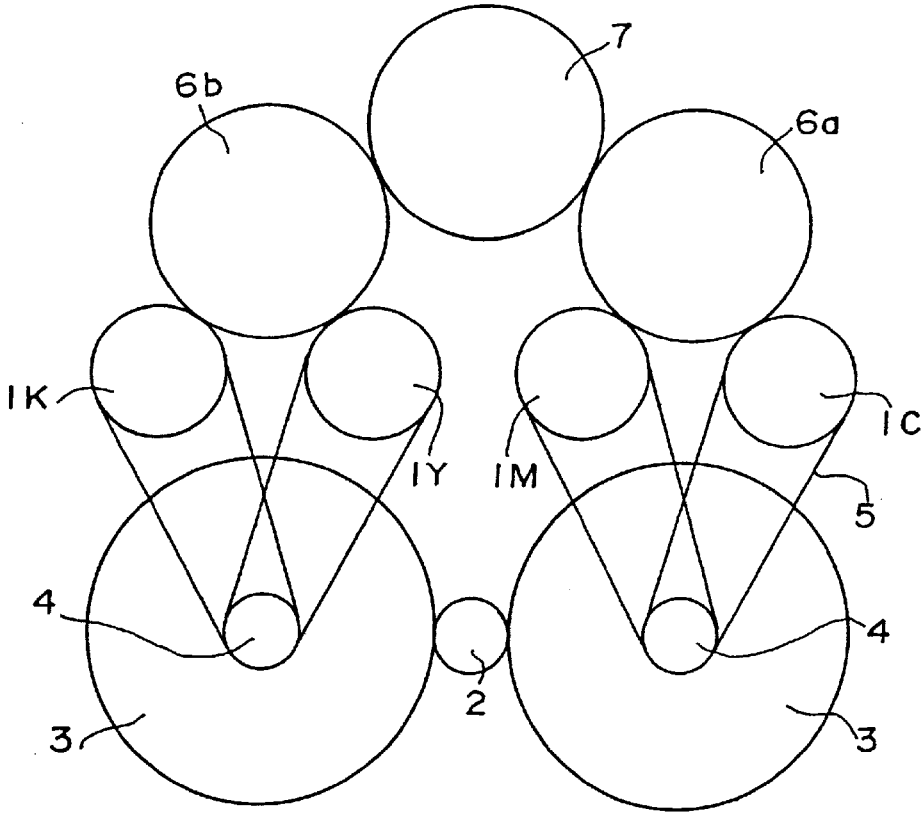
FIG. 2 is a schematic view of a photoconductor driver for explaining the second embodiment.

FIG. 2 is a schematic view of a photoconductor driver for explaining the second embodiment.

The second embodiment uses the structure of the first embodiment as it is. In the second embodiment, the photoconductor coupling gear 6*a* and the photoconductor coupling gear 6*b* are coupled by a photoconductor coupling gear 7, thereby forming a power transmitting system different from the power transmitter.

The photoconductor coupling gear 7 forcibly couples the photoconductor drums 1C to 1K, so that the vibrations are more effectively restrained.

Third Embodiment

Figure 3:
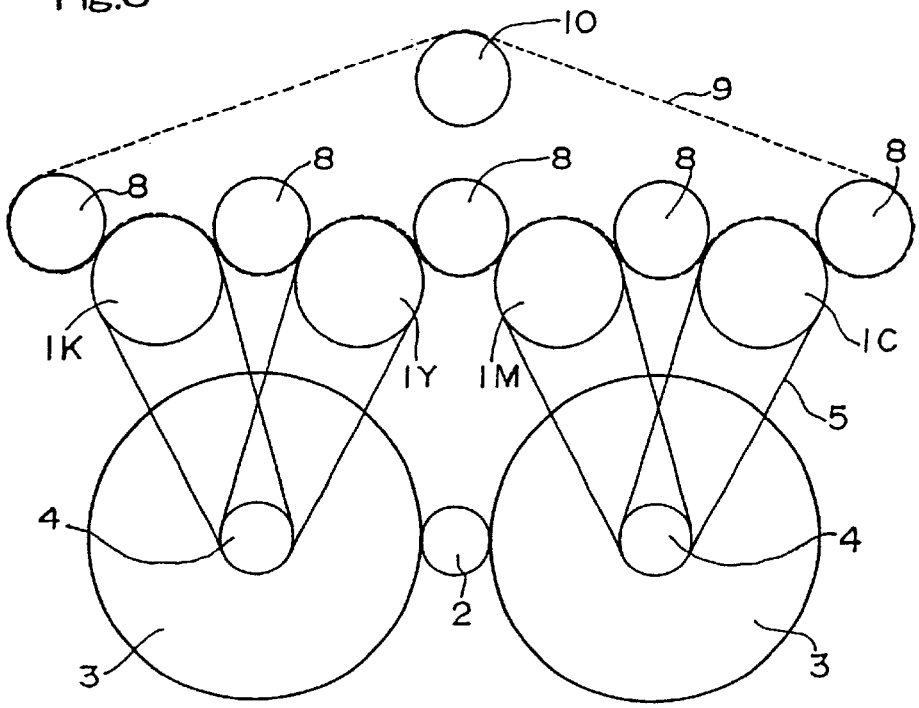
FIG. 3 is a schematic view of a photoconductor driver for explaining the third embodiment.

FIG. 3 is a schematic view of a photoconductor driver for explaining the third embodiment of the present invention.

The third embodiment uses part of the structure of the first embodiment other than the photoconductor coupling gears 6*a* and 6*b* as it is.

Part of each of the photoconductor drums 1C to 1K functions as a pulley. A belt 9 laid across gears 8 and a pulley 10 is entrained about the photoconductor drums 1C to 1K, thereby forming a power transmitting system different from the power transmitter. The rotations of the photoconductor drums 1C to 1K are forcibly integrated by the belt 9.

The use of the belt enables the photoconductor drums 1C to 1K to be coupled in one stage as shown in FIG. 3. Since the belt 9 is flexible and excellently absorbs vibration energy, the rotation timings of the photoconductor drums 1C to 1K can be more effectively prevented from disaccording with one another.

Fourth Embodiment

Figure 4:
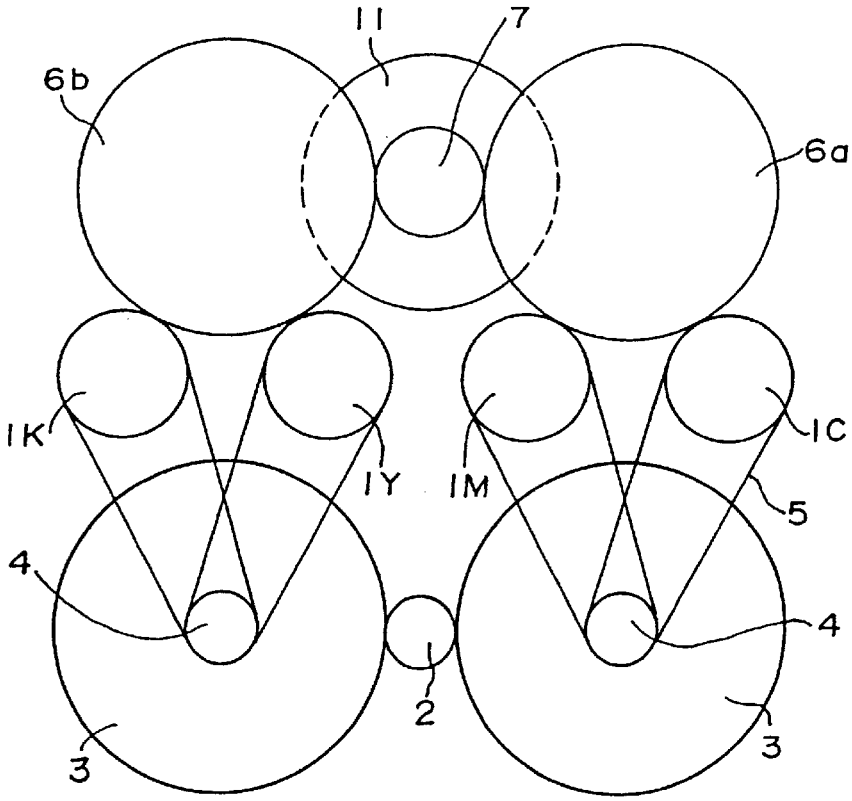
FIG. 4 is a schematic view of a photoconductor driver for explaining the fourth embodiment.

FIG. 4 is a schematic view of a photoconductor driver for explaining the fourth embodiment of the present invention.

The fourth embodiment uses the structure of the second embodiment as it is. A flywheel 11 is added to the photoconductor coupling gear 7 of the second embodiment, thereby forming a power transmitting system different from the power transmitter. The vibration energy is accumulated in the flywheel 11 and discharged therefrom, so that the vibrations are more effectively restrained.

Fifth Embodiment

Figure 5:
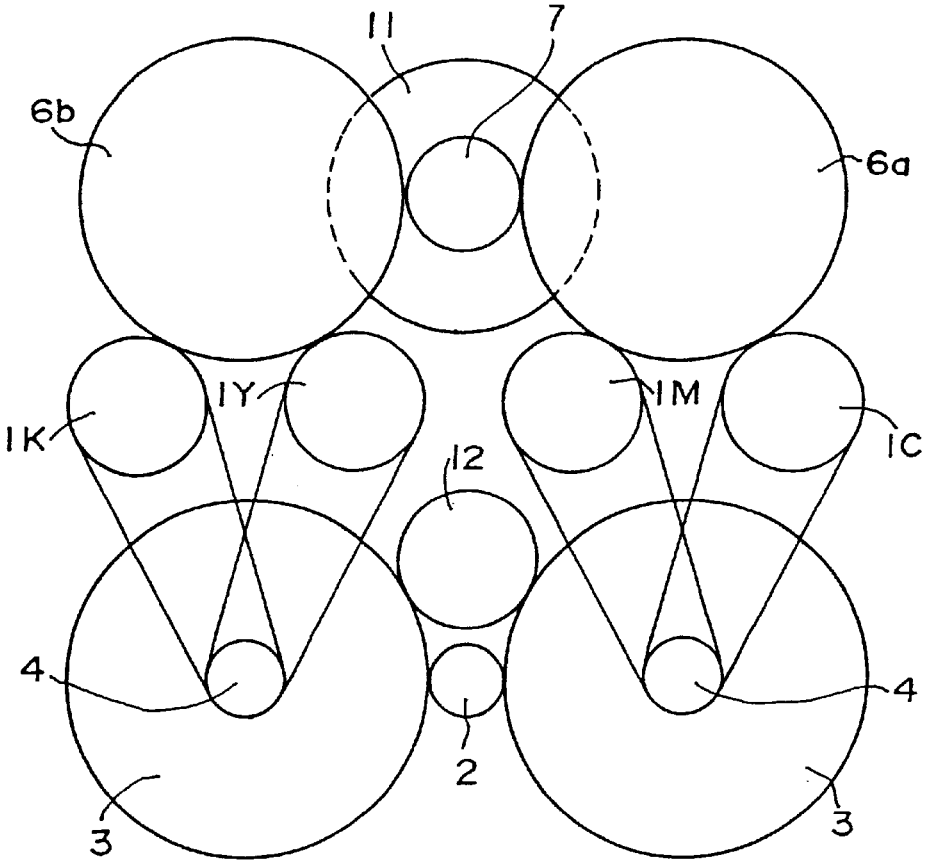
FIG. 5 is a schematic view of a photoconductor driver for explaining the fifth embodiment.
Figure 6:
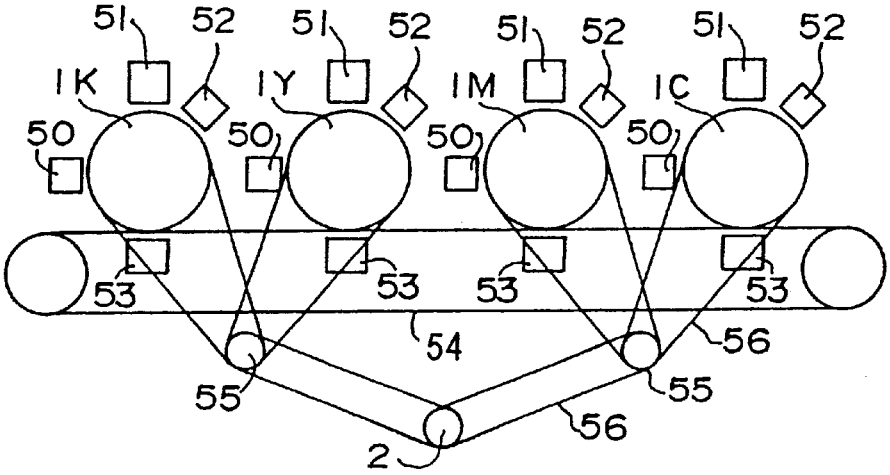
FIG. 6 is a schematic view showing an outline of the tandem image forming apparatus and the photoconductor drum driving systems.

FIG. 5 is a schematic view of a photoconductor driver for explaining the fifth embodiment of the present invention.

The fifth embodiment uses the structure of the fourth embodiments it is. Apart from a the photoconductor coupling gear 7 of the fourth embodiment, a flywheel 12 having a gear meshing with the reduction gears 3 is provided. This forms another power transmitting system that is different from the power transmitter. The vibration energy is accumulated in the flywheel 12 and discharged therefrom, so that the vibrations are more effectively restrained because of the cooperation with the flywheel 11.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

first and second photoconductor drums;

a driving member for rotating said first and second photoconductor drums; and a restricting member coupled to said first and second photoconductor drums to restrict rotations of said first and second photoconductor drums by associating the rotations apart from said driving member.

2. The image forming apparatus in claim 1, wherein said driving member is constituted of gears and belts.

3. The image forming apparatus in claim 1, wherein said restricted member is a gear.

4. An image forming apparatus comprising:

first to fourth photoconductor drums;

a driving source;

a transmitting member for transmitting power of said driving source to said photoconductor drums to rotate said photoconductor drums;

a first restricting member being rotatably held and being coupled to said first and second photoconductor drums to restrict rotations of said first and second photoconductor drums, said first restricting member being a member different from said transmitting member; and a second restricting member being rotatably held and being coupled to said third and fourth photoconductor drums to restrict rotations of said third and fourth photoconductor drums, said second restricting member being a member different from said transmitting member.

5. The image forming apparatus in claim 4, further comprising a third restricting member rotatably held and being coupled to said first and second restricting members to restrict rotations of said first and second restricting members.

6. The image forming apparatus in claim 5, further comprising a flywheel installed on the third restricting member.

7. The image forming apparatus in claim 5, wherein said third restricting member is a gear.

8. The image forming apparatus in claim 4, further comprising a third restricting member being rotatably held and being coupled to said second and third photoconductor drums to restrict rotations of said second and third photoconductor drums, said third restricting member being a member different from said transmitting member.

9. The image forming apparatus in claim 8, wherein said third restricting member is a gear.

10. The image forming apparatus in claim 4, further comprising a restricting belt to restrict rotations of the first and second restricting members.

11. The image forming apparatus in claim 10, wherein said restricting belt is held rotatably through medium of pulleys.

12. The image forming apparatus in claim 4, wherein said first and second restricting members are gears.

13. An image forming apparatus comprising:

first to fourth photoconductor drums;

a driving source;

a transmitting member for transmitting power of said driving source to said first and second photoconductor drums to rotate said first and second photoconductor drums;

a first rotary member through which the power of said driving source is transmitted to said first and second photoconductor drums, said first rotary member being rotatably held;

a second rotary member through which the power of said driving source is transmitted to said third and fourth photoconductor drums, said second rotary member being rotatably held; and a restricting member being rotatably held and being coupled to first and second rotary members to restrict rotations of said first and second rotary members, said restricting member being a member different from said rotary members.

14. The image forming apparatus in claim 13, wherein said first and second rotary members are gears.

15. The image forming apparatus in claim 13, wherein said restricting member is a gear.

16. The image forming apparatus in claim 13, wherein said transmitting member is constituted of belts.

* * * * *